United States Patent [19]

Pavio

[11] Patent Number: 5,025,232

[45] Date of Patent: Jun. 18, 1991

[54] MONOLITHIC MULTILAYER PLANAR TRANSMISSION LINE

[75] Inventor: Anthony M. Pavio, Plano, Tex.

[73] Assignee: Texas Instruments Incorporated, Dallas, Tex.

[21] Appl. No.: 429,679

[22] Filed: Oct. 31, 1989

[51] Int. Cl.[5] ..... H01P 5/10

[52] U.S. Cl. ..... 333/26; 333/238

[58] Field of Search ..... 333/1, 26, 238, 246

[56] References Cited

U.S. PATENT DOCUMENTS

| | | | |
|---|---|---|---|
| 3,961,296 | 6/1976 | Wiggenhorn | 333/238 |
| 3,976,959 | 8/1976 | Gaspari | 333/26 |
| 4,288,761 | 9/1981 | Hopfer | 333/238 X |
| 4,755,775 | 7/1988 | Marczewski et al. | 333/26 |

*Primary Examiner*—Paul Gensler

*Attorney, Agent, or Firm*—René E. Grossman; Melvin Sharp

[57] ABSTRACT

A multilayer planar transmission line (10) can be fabricated as a monolithic structure with series/shunt-connected components for integration in an MMIC device. The multilayer planar transmission line (10) includes a first transmission line structure (TL1) formed by a top conductor (14) and an interlevel conductor (16) separated by an interlevel dielectric (18). This structure is formed on one planar surface of a substrate (12), and a ground plane reference (20) is formed on the opposing surface, yielding second and third transmission line structures (TL2, TL3) formed by the groundplane reference and, respectively, the interlevel conductor (16) and the top conductor (14). The interlevel dielectric layer (18) is significantly thinner than the substrate dielectric, so that the first transmission line (TL1) is tightly coupled, and substantially unaffected by parasitics between the bottom of the interlevel conductor (16) and the groundplane reference (20). In an exemplary embodiment, a monolithic multilayer planar transmission line network is configured as a Marchand-type balun (30). A top conductor (34) is configured in two continuous sections (Z1 and Z2), and an interlevel conductor (36) is configured in two separate sections (ZS1) and ZS2), separated by a balance point gap (BP). This configuration forms series transmission lines (Z1 and Z2) shunt-connected to a second pair of series transmission lines (ZS1 and ZS2). With the appropriate configuration of the top and interlevel conductors (34, 36), impedance values can be established to yield a balanced signal output at the balance point gap (BP).

12 Claims, 1 Drawing Sheet

MONOLITHIC MULTILAYER PLANAR TRANSMISSION LINE

TECHNICAL FIELD OF THE INVENTION

This invention relates in general to radio frequency devices, and more particularly to a monolithically-fabricated multilayer planar transmission line, and method of fabrication.

BACKGROUND OF THE INVENTION

For an increasing number of radio frequency applications, particularly in the microwave region, fabricating circuit devices using MMIC (monolithic microwave integrated circuit) techniques presents significant advantages in terms of cost and reliability.

Some microwave devices are difficult to implement monolithically, typically because of the size constraints inherent in integrated circuit fabrication. In particular, microwave devices requiring transmission line components have proved difficult to fabricate because the transmission line components often require series and/or shunt connections that cannot be achieved using conventional monolithic planar fabrication techniques. In particular, the conventional microstrip technique for monolithically fabricating planar transmission lines cannot be used to fabricate transmission line components with series/shunt connections.

An alternative design approach is to use non-planar coaxial transmission lines for the transmission line components. However, coaxial structures are cumbersome to integrate with MMIC components. Another alternative design uses suspended microstrip techniques in which a conductor is suspended over a surface separated by an air dielectric gap. However, suspended substrate techniques are impractical to implement monolithically due to the circuit area required and the fragility of the typical GaAs substrate material.

An example of a microwave device that is difficult to synthesize in MMIC is a passive balun. While transformer hybrids are common at lower frequencies, as the frequency of operation extends into the microwave region (above several GHz), transformer hybrids can no longer be economically fabricated. At these frequencies, transmission line passive baluns are the only practical solution. However, transmission line baluns typically involve series and shunt connected transmission line components with different lengths and impedances to achieve flexibility in matching. As a result, transmission line baluns have heretofore not been integrated into monolithic MMIC designs.

Accordingly, a need exists for a planar transmission line that can be fabricated monolithically with series/shunt connected components, allowing integration into an MMIC device.

SUMMARY OF THE INVENTION

The present invention is a planar transmission line that can be fabricated as a monolithic structure with series/shunt connected components for integration in an MMIC device.

In one aspect of the invention, a monolithic multilayer planar transmission line is fabricated onto an integrated circuit substrate (dielectric), which has two substantially planar opposing surfaces. An interlevel conductor is disposed on one substantially planar surface of the substrate. An interlevel dielectric layer, significantly thinner than the substrate dielectric, is disposed over the interlevel conductor and a top conductor is disposed over the interlevel dielectric layer. A groundplane reference is disposed on the opposing surface of the substrate.

The top conductor and the interlevel conductor form a top/interlevel transmission line, the interlevel conductor and the groundplane form an interlevel/groundplane transmission line, and the top conductor and the groundplane form a top/groundplane transmission line. The interlevel dielectric layer is made relatively thin (substantially thinner than the substrate dielectric) so that the top conductor and interlevel conductor form a tightly coupled transmission line. The electrical characteristics of the transmission lines in terms of impedance, bandwidth and frequency response, are determined by selecting the dielectric constants for the interlevel and substrate dielectrics, and the dimensions (principally width and length) of the conductors.

In another aspect of the invention, series/shunt connections between transmission lines are formed by selectively configuring the interlevel conductor in sections separated by gaps. For example, introducing a single gap into the interlevel conductor defines two interlevel conductor sections, and creates four series/shunt-connected transmission line components, i.e., two transmission line components formed between each of the interlevel conductor sections and, respectively, the top conductor and the groundplane reference.

In more specific aspects of the invention, the monolithic multilayer planar transmission line is used to form an exemplary monolithically integrated balun. The exemplary balun is in a Marchand configuration requiring series/shunt connections between four transmission line components, together with a fifth center-tap transmission line component to connect to the balance point (0°/180°).

The interlevel conductor is formed as a strip with a single balance point gap defining two interlevel conductor sections. The top conductor is formed as a continuous strip over the interlevel dielectric covering the interlevel conductor sections. Thus, two series-connected transmission line components are formed between respective interlevel conductor sections and the top conductor strip, and two series-connected transmission line components are formed between respective interlevel conductor sections and the groundplane reference. A shunt connection between the pairs of series-connected transmission lines is located at the balance point gap, and these transmission line components are configured such that balanced signals appear at that point gap. In addition, a microstrip connection can be made to the balance point gap for access to the balanced signals.

The technical advantages of the invention include the following. The multilayer transmission line can be fabricated in planar monolithic structures integrated into MMIC devices—as an example, a multilayer planar transmission line network can be configured as a passive balun for inclusion in an MMIC microwave mixer. The use of top and interlevel conductors and a groundplane reference forms three transmission lines, with the top/interlevel and the interlevel/groundplane transmission lines being the principle design structures. The top/groundplane transmission line introduces parasitic impedance effects that can be compensated for in the design process—specifically, the top/interlevel transmission line is made tightly coupled to reduce the effect of parasitics introduced from the bottom side of the interlevel conductor with respect to the groundplane reference. The multilayer structure allows flexible configuration of series and shunt transmission line components (such as for a passive balun). The electrical properties of the transmission line components can be flexibly determined by selecting substrate/interlevel dielectric constants and top/interlevel conductor dimensions (primarily length and width). The multilayer planar transmission line structure offers significant advantages over suspended microstrip techniques, including mechanical rigidity, small size and compatibility with other active components.

BRIEF DESCRIPTION OF THE DRAWINGS

For a more complete understanding of the present invention, and for further features and advantages, reference is now made to the following Detailed Description, taken in conjunction with the accompanying Drawings, in which.

DETAILED DESCRIPTION OF THE INVENTION

The Detailed Description of the preferred embodiment of the monolithic multilayer planar transmission line, and fabrication method, of the invention is organized as follows:

1. Multilayer Planar Transmission Line
2. Exemplary Balun
3. Conclusion

This Detailed Description includes a description of the monolithic multilayer planar transmission line structure in an exemplary configuration as a Marchand balun for use in microwave applications (such as frequency mixers). However, the multilayer planar transmission line structure of this invention is readily adaptable to other configurations or applications in which series and/or shunt transmission line component configurations are required to implement a monolithic integrated circuit design.

1. Multilayer Planar Transmission Line

Figure 1:
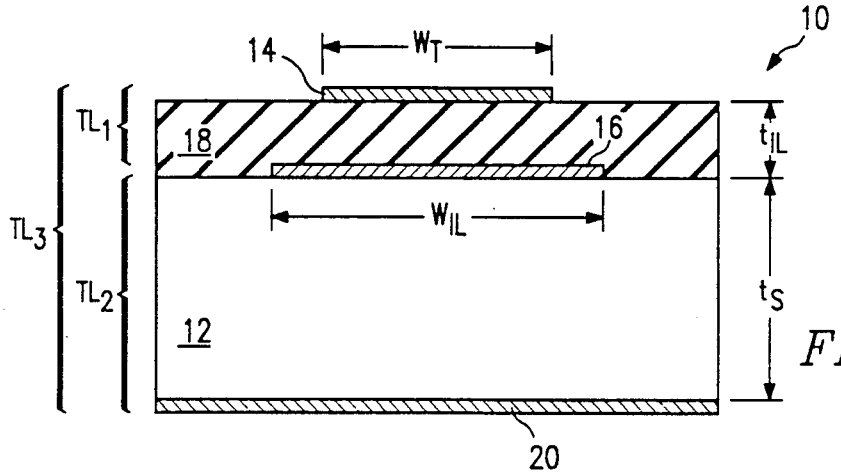
FIG. 1 is an illustrative cross-sectional view of a monolithic multilayer planar monolithic transmission line of the invention, showing the top and interlevel conductors and the groundplane reference, insulated by interlevel and substrate dielectrics.

The multilayer planar transmission line structure 10 of the invention, shown in FIG. 1, can be monolithically fabricated on a standard MMIC substrate 12 (such as GaAs). The substrate has a dielectric constant $E_{R1}$ and has a thickness of $t_S$.

A planar transmission line is formed over the substrate, and includes a top conductive layer 14 and an interlevel conductive layer 16 separated by an interlevel dielectric layer 18. Interlevel conductive layer 16 is formed over one of the substantially planar surfaces of the substrate 12. The interlevel dielectric is formed over the interlevel conductive layer and adjacent portions of the substrate 12. The top conductive layer is formed over the interlevel dielectric, above the interlevel conductor.

The top conductor 14 has a width $w_T$, and the interlevel conductor has a width $w_{IL}$. The interlevel dielectric layer 18 has a thickness of $t_{IL}$, and a dielectric constant of $E_{R2}$.

A groundplane conductive layer 20 is formed on the opposing planar surface of substrate 12. The groundplane conductor forms the ground reference for the multilayer transmission line.

The multilayer planar structure of the invention forms three transmission lines. A transmission line TL1 is formed by the top conductor 14 and the interlevel conductor 16, together with the interlevel dielectric layer 18. A transmission line TL2 is formed by the interlevel conductive layer 16 and the groundplane reference 20, together with the substrate dielectric 12.

A third transmission line TL3 is formed by the top conductive layer 14 and the groundplane reference, together with the interposed substrate dielectric 12 and interlevel dielectric 18. For most designs, this transmission line contributes unwanted parasitic impedance effects—these effects are minimized by tightly coupling the TL1 transmission line, and then compensating for any remaining effects in the overall design.

The transmission line characteristics of the three transmission lines, TL1, TL2 and TL3, are primarily determined by the following parameters:

(a) Substrate dielectric constant $E_{R1}$ and interlevel dielectric constant $E_{R2}$;
(b) The respective thicknesses of the substrate dielectric and the interlevel dielectric; and
(c) The planar dimensions of the top conductor 14 and interlevel conductor 16, and the groundplane reference 20.

The thickness of the conductive layers 14, 16 and 18 are not critical, and may be selected in accordance with conventional monolithic fabrication techniques.

The thickness $t_S$ of the substrate 12 will generally be determined by standard monolithic integrated circuit fabrication considerations, rather than being a matter of design specification for the multilayer planar transmission line structure. That does not present a significant design restriction, as standard substrate thicknesses of about 2–20 mils (50–500 microns) are sufficiently large that the transmission line TL1 can be made tightly coupled by the appropriate selection of the thickness $t_{IL}$ of the interlevel dielectric layer. This tight coupling avoids significant parasitics between this transmission line and the groundplane reference 20. A typical thickness $t_{IL}$ for the interlevel dielectric layer is about 0.1–0.4 mils (2.5–10 microns).

Selecting the dielectric material for the substrate dielectric 12 is a design choice, although GaAs is the conventional substrate material for MMIC fabrication. An alternative substrate dielectric material is Alumina. Typical dielectric constants $E_{R1}$ for a GaAs substrate are about 12.9, and for an Alumina substrate are about 9.9.

Selecting a dielectric material for the interlevel dielectric layer 18 is a design choice. The recommended dielectric material is polyamid, although silicon nitride $Si_3N_4$ provides a completely acceptable alternative. Typical dielectric constants $E_{R2}$ for a polyamid material are about 3.6, and for the silicon nitride are about 5.5 (4–7).

Selecting the dimensions for the top conductive layer 14 and the interlevel conductive layer 16, and the groundplane reference 20, are design choices, depending upon the transmission line topology, and the frequency and bandwidth requirements for the device incorporating the transmission line components fabricated using the monolithic planar technique of the invention, as well as the impedance requirements for each transmission line component. Typically, the transmission line TL1 will be formed from respective elongate strips of conductive material, with the interlevel conductor being configured in sections separated by gaps (on the order of about 4–5 mils or 100 microns) to create a desired configuration of series/shunt transmission line components (see Section 2). For a given length of the top conductive layer 14, its width $w_T$ is chosen to obtain the desired transmission line characteristics. Similarly, for a given length and sectioning of interlevel conductive layer 16, the width of the layer $w_{IL}$ is chosen to obtain the desired transmission line characteristics for each section. Moreover, as illustrated in Section 2, the respective widths of the top and interlevel connective layers can be altered over the course of their length, providing additional flexibility in impedance selection and design.

Selecting the conductive materials for the top and interlevel layers, and the ground plane reference are design choices. Acceptable materials include any used in conventional planar monolithic fabrication, such as gold.

To summarize, implementing a specific monolithic transmission line network using the multilayer planar technique of the invention involves routine transmission line design considerations to achieve a desired transmission line performance for the frequency and bandwidth of interest. The basic configuration of the top and interlevel conductive layers/strips, and the groundplane reference, must be selected to achieve an appropriate number of transmission line components and series/-shunt connections. And, for a given substrate dielectric material (with a specific thickness $t_S$ and dielectric constant $E_{R1}$), the planar dimensions and configurations of the top and interlevel conductors (length and width), together with the planar dimensions and thickness of the interlevel dielectric (and its dielectric constant), are selected to achieve a desired impedance for each transmission line component of the multilayer structure.

2. Exemplary Balun

The design approach for implementing a specific monolithic transmission line network using a multilayer planar structure according to the invention is illustrated in connection with an exemplary design for a passive balun of the Marchand type.

Figure 2:
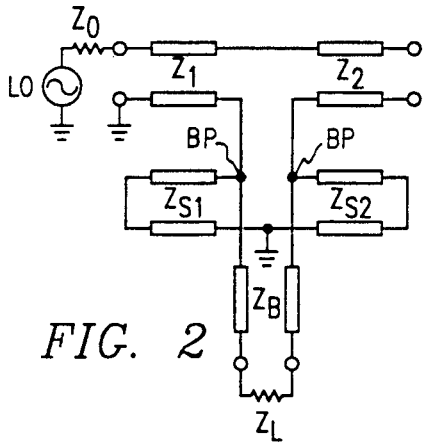
FIG. 2 is a transmission line model of a Marchand balun.

FIG. 2 shows a transmission line model for a Marchand balun (sometimes referred to as a compensated Marchand balun). This balun network can be implemented with four transmission line components with different lengths and impedances—$Z_1/Z_2$ and $Z_{S1}/Z_{S2}$. This balun network is a multi-element band pass network providing a considerable amount of flexibility in matching through the specification of the impedance values for the four transmission line components. Usually, $Z_1$ and $Z_2$ are designed to be of equal value, and $Z_{S1}$ and $Z_{S2}$, which are effectively in series and then shunted across the balance load, are made as large as possible. The balance point BP appears at the shunt connection between $Z_1/Z_2$ and $Z_{S1}/Z_{S2}$.

Transmission line $Z_B$ has a characteristic impedance value of that of the balanced termination, although it can be used as a matching section. If proper filter synthesis methods are employed in the design of the compensated balun, excellent multi-octave performance can be obtained.

Figure 3B:
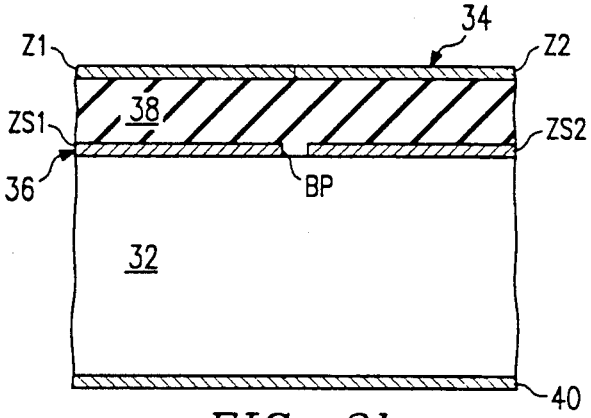
FIG. 3*b* is a cross-sectional view of a portion of the multilayer planar balun structure showing the balance point gap in the interlevel conductor.
Figure 3A:
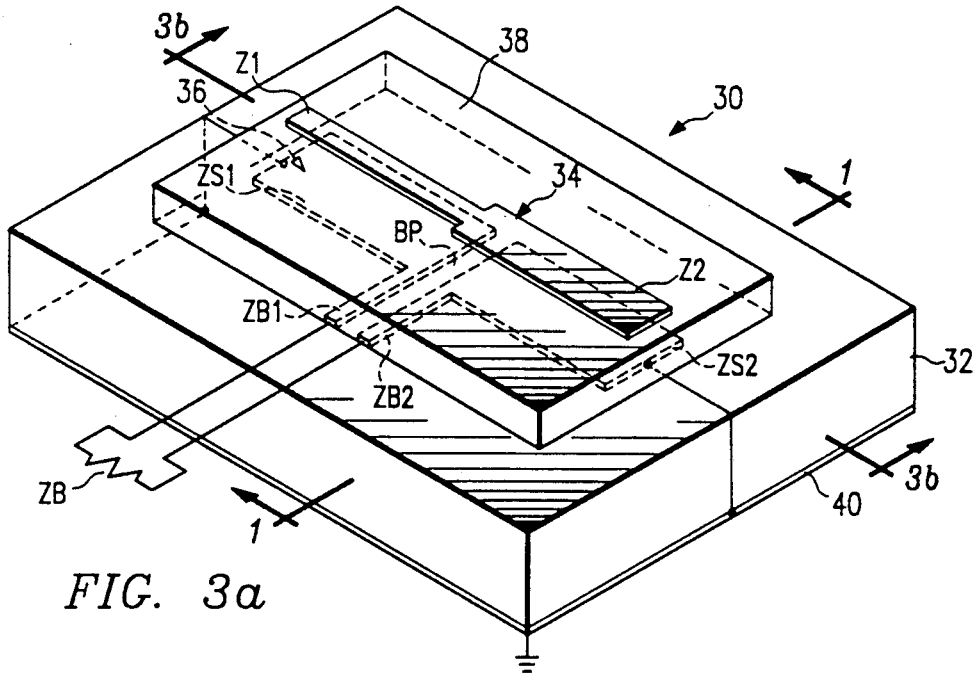
FIG. 3*a* is a top isometric view of a multilayer planar structure configured as a Marchand balun.

FIGS. 3*a* and 3*b* show an exemplary implementation of a compensated Marchand balun using a monolithic multilayer planar transmission line structure according to the invention. With reference to the isometric view in FIG. 3*a*, an integrated circuit substrate 32 has formed on one surface a transmission line structure defined by a top conductive strip 34 and an interlevel conductive strip 36, separated by an interlevel dielectric layer 38. A groundplane reference layer 40 is formed on the opposing planar surface of the substrate dielectric 32.

Top conductor 34 includes a relatively narrow $Z_1$ section and a relatively wide $Z_2$ section. Interlevel conductor 36 includes a $Z_{S1}$ section underlying the $Z_1$ top conductor section, and a $Z_{S2}$ section underlying the $Z_2$ top conductor section. Top conductor 34 ($Z_1/Z_2$) is continuous in length, while the interlevel conductor 36 ($Z_{S1}/Z_{S2}$) includes a central balance point gap BP that centers on the transition between the $Z_1/Z_2$ sections of the top conductor 34. The interlevel conductor sections $Z_{S1}$ and $Z_{S2}$ are grounded, as is the groundplane reference 40.

This multilayer planar transmission line structure corresponds to the transmission line model of a compensated Marchand balun shown in FIG. 2. The transmission line component $Z_1$ in FIG. 2 corresponds to the transmission line component formed by the $Z_1$ section of the top conductor 34 and the underlying $Z_{S1}$ section of the interlevel conductor 36, while the transmission line component $Z_2$ in FIG. 2 corresponds to the transmission line component formed by the $Z_2$ section of the top conductor 34 and the underlying $Z_{S2}$ section of the interlevel conductor. The shunt transmission line component $Z_{S1}$ in FIG. 2 corresponds to the transmission line component formed by the $Z_{S1}$ section of the interlevel conductive layer 36 and the groundplane reference 40, while the shunt transmission line component $Z_{S2}$ in FIG. 2 corresponds to the transmission line component formed by the $Z_{S2}$ section of the interlevel conductor and the ground plane reference.

The balance point BP of the Marchand balun in FIG. 2 corresponds to the balance point gap BP between the $Z_{S2}$ and $Z_{S2}$ sections of the interlevel conductor 36. The center-tap connection to the balance point BP represented by the transmission line component $Z_B$ in FIG. 2 corresponds to a pair of microstrip transmission line strips $Z_{B1}$ and $Z_{B2}$ (see FIG. 3*a*) extending from the balance point ends of respective $Z_{S1}$ and $Z_{S2}$ sections of the interlevel conductor 36. These balance point microstrip connections $Z_{B1}$ and $Z_{B2}$ extend along the surface of substrate dielectric 32, beneath the interlevel dielectric 38 to the periphery of the monolithic Marchand-type balun. Alternatively, circuit components can be located at the balance point.

As with the transmission line model of a compensated Marchand balun illustrated in FIG. 2, the monolithic multilayer planar Marchand balun structure shown in FIGS. 3*a* and 3*b* is a multi-element band pass network that provides a considerable amount of flexibility and matching through the selection of the impedances for the transmission line components $Z_1/Z_2$ and $Z_{S1}/Z_{S2}$. In addition, the center-tap transmission line component $Z_{B1}/Z_{B2}$ can be chosen to exhibit the characteristic impedance value of the balanced termination, or it can be used as an additional matching section. Using conventional filter synthesis in the design of the monolithic balun, excellent multi-octave performance can be obtained.

As described in Section 1, transmission line characteristics for the transmission line components of the monolithic multilayer planar balun structure 30 are determined by the appropriate selection of the dielectric constants for the substrate dielectric ($E_{R1}$) and the interlevel dielectric ($E_{R2}$), the respective t of those dielectrics, an configuration of the top and interlevel conductors and the ground plane reference. The transmission line components $Z_1/Z_{S1}$ and $Z_2/Z_{S2}$ will be chosen to achieve a desired broadband performance. Typically, overall MMIC design considerations determine the choice of a substrate dielectric, and its thickness. However, conventional substrate dielectric thicknesses are such that the transmission line components formed by the top and interlevel conductors 34/36 and the interlevel dielectric 38 can be readily configured to provide good balun performance, and in particular, to provide $Z_1/Z_{S1}$ and $Z_2/Z_{S2}$ transmission line components that are sufficiently coupled that parasitics introduced from the bottom side of the interlevel conductor with respect to the ground reference (which would normally destroy the performance of a non-suspended balun) do not significantly impact circuit performance.

By way of example, a Marchand-type balun can be implemented using a monolithic multilayer planar transmission line structure according to the invention, with the following structural parameters. A GaAs substrate is chosen with a thickness of about 100 microns and a dielectric constant of about 12.9. A silicon nitride interlevel dielectric is chosen with a thickness of about 4 microns and a dielectric constant of about 5.5. The $Z_1$ top conductor section is about 1,000 microns long and 15 microns wide, while the $Z_2$ top conductor section is about 1,000 microns long and 75 microns wide. The $Z_{S1}/Z_{S2}$ interlevel conductor sections are both about 1,000 microns long and 75 microns wide, with a balance point gap of about 4–5 mils (100 microns) between them. Such a monolithic passive balun could be used in a wide variety of radio frequency (microwave) devices fabricated using MMIC. For example, a multilayer planar passive balun according to the invention could be used as a passive balun section of an MMIC mixer.

3. Conclusion

The multilayer transmission line structure of the invention is fabricated using planar monolithic techniques for solid state integration (such as MMIC). The substrate and interlevel dielectrics can be cooperatively configured such that the transmission line components formed by the top and interlevel conductors are tightly coupled, and substantially unaffected by the groundplane reference. The multilayer structure offers three transmission line configurations—top/interlevel, interlevel/groundplane and top/groundplane. The top and interlevel conductors can be configured to provide selected transmission line series and shunt interconnections, with impedance characteristics being determined by the dimensioning of the conductors (and the selection of an interlevel dielectric material).

Although the present invention has been described with respect to a specific, preferred embodiment, and an exemplary application, various changes and modifications may be suggested to one skilled in the art, and it is intended that the present invention encompass such changes and modifications as fall within the scope of the appended claims.

What is claimed is:

1. A multilayer planar transmission line, comprising:

(a) a dielectric substrate with substantially planar opposing surfaces of a predetermined planar configuration;

(b) an interlevel conductive layer configured by at least one balance point gap, such that separate transmission lines are provided between each of the interlevel conductor sections and, respectively, a top conductive layer and a groundplane reference;

(c) an interlevel dielectric layer of a predetermined planar configuration disposed over said interlevel conductor with a predetermined dielectric constant significantly thinner than said substrate;

(d) said top conductive layer being of predetermined planar configuration disposed over said interlevel dielectric layer;

(e) said groundplane conductive layer disposed on the opposing substantially planar surface of said substrate, providing a groundplane reference for said top conductive layer and said interlevel conductive layer to provide three transmission lines, a top/interlevel transmission line, an interlevel/groundplane transmission line, and a top/groundplane transmission line with predetermined impedance characteristics;

(f) input terminals across one of said sections of said interlevel conductive layer and said top conductive layer; and (g) a load coupled across said balance point gap.

2. The multilayer transmission line of claim 1, wherein said substrate and interlevel dielectrics are cooperatively configured such that said top/interlevel transmission line is substantially electrically unaffected by said groundplane reference.

3. The multilayer transmission line of claim 1, wherein said top conductive layer and said sectioned interlevel conductive layer are configured to form selected transmission line connections.

4. The multilayer transmission line of claim 1, wherein said interlevel conductive layer is an elongate strip.

5. The multilayer transmission line of claim 4, wherein said top conductive layer is an elongate strip overlying said interlevel conductive strip.

6. The multilayer transmission line of claim 1, wherein said substrate dielectric is GaAs.

7. The multilayer transmission line of claim 1, wherein said interlevel dielectric layer is polyamid.

8. The multilayer transmission line of claim 1, wherein said interlevel dielectric layer is $Si_3N_4$.

9. A monolithic transmission line balun having multilevel planar transmission lines, comprising:

(a) a dielectric substrate with substantially planar opposing surfaces;

(b) an interlevel conductive strip of a predetermined planar configuration disposed on one substantially planar surface of said substrate;

(c) said interlevel conductive strip including at least first and second electrically isolated sections separated by a balance point gap;

(d) input terminals connected across one of said first and second sections and a top conductive strip, and a load connected across said balance point gap;

(e) an interlevel dielectric layer of a predetermined planar configuration disposed over said interlevel conductive strip and the adjacent portions of said substrate significantly thinner than said substrate;

(f) said top conductive strip of a predetermined planar configuration disposed on said interlevel dielectric layer overlying said at least two interlevel conductor sections; and (g) a groundplane conductor disposed on the opposing substantially planar surface of said substrate providing a groundplane reference for said top and interlevel conductive strips, said top conductive strip and said respective first and second electrically isolated sections providing first and second series top/interlevel transmission lines, and said electrically isolated sections and said groundplane reference providing first and second series interlevel/groundplane transmission lines;

(h) said first and second series interlevel/groundplane transmission lines providing a shunt connection with said first and second series top/interlevel transmission lines;

(i) the planar configurations of said top and interlevel conductive strips and the dielectric constants of said substrate and interlevel dielectric layer being cooperatively chosen to achieve a predetermined impedance transformation for the balanced output at said balance point gap.

10. The monolithic transmission line balun of claim 9, further comprising:

a first conductive strip formed on said substrate and coupled to said first electrically isolated section; and a second conductive strip formed on said substrate and coupled to said second electrically isolated section;

said first and second conductive strips forming a microstrip transmission line connection to the balance point gap.

11. The monolithic transmission line balun of claim 10, wherein said microstrip transmission line has the characteristic impedance of a balanced termination.

12. The monolithic transmission line balun of claim 10, wherein said microstrip transmission line is used as a matching section.

* * * * *